US006513579B1

(12) United States Patent
Kent et al.

(10) Patent No.: US 6,513,579 B1
(45) Date of Patent: Feb. 4, 2003

(54) POST BRAZE HEAT EXCHANGER MOUNTING AND SUPPORT BRACKETS

(75) Inventors: Scott Edward Kent, Albion, NY (US); David A. Southwick, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/965,554

(22) Filed: Sep. 27, 2001

(51) Int. Cl.[7] ..... F28F 9/007
(52) U.S. Cl. ..... 165/67; 165/906; 180/68.4
(58) Field of Search ..... 165/67, 178; 180/68.4

(56) References Cited

U.S. PATENT DOCUMENTS

| | | | | |
|---|---|---|---|---|
| 5,205,349 A | | 4/1993 | Nagao et al. | 165/67 |
| 5,348,079 A | * | 9/1994 | Tanaka | 165/67 |
| 5,429,182 A | | 7/1995 | Hanafusa | 165/67 |
| 5,509,473 A | | 4/1996 | Tokutake | 165/178 |
| 5,535,819 A | | 7/1996 | Matsuura | 165/149 |
| 5,632,332 A | * | 5/1997 | Hanafusa | 165/153 |
| 5,671,803 A | | 9/1997 | Tepas et al. | 165/41 |
| 5,697,431 A | * | 12/1997 | Nagasaka | 165/149 |
| 6,202,819 B1 | | 3/2001 | Giroire | 192/91 A |

FOREIGN PATENT DOCUMENTS

| | | | | |
|---|---|---|---|---|
| DE | 4232018 A1 | * | 3/1994 | 165/67 |
| EP | 504635 A1 | * | 2/1992 | 165/67 |

OTHER PUBLICATIONS

GM Product Assembly Document—2001 C/K Truck Product 06.

* cited by examiner

*Primary Examiner*—Allen Flanigan
(74) *Attorney, Agent, or Firm*—Patrick M. Griffin

(57) ABSTRACT

An automotive condenser includes closely nested, plastic molded support brackets solidly tightly fitted to the four corners thereof, post braze and with no separate fasteners, which adhere to the corners solidly enough to prevent any significant twisting or shifting relative thereto. A reinforced support flange on the bracket is stiff enough to prevent any significant twisting relative to the bracket itself, when subjected to the level of torque to be expected when an inlet or outlet pipe of the condenser is installed to a refrigerant line. Therefore, the support flange of the bracket can hold the end of the pipe solidly enough to allow the refrigerant line to be connected thereto with no need for a back up tool or other external support to resist the torque.

6 Claims, 5 Drawing Sheets

POST BRAZE HEAT EXCHANGER MOUNTING AND SUPPORT BRACKETS

TECHNICAL FIELD

This invention relates to automotive air conditioning and in general, and specifically to novel design for automotive heat exchanger mounting and support brackets.

BACKGROUND OF THE INVENTION

Automotive condensers comprise a basic central core comprised of regularly spaced tubes and intermediate corrugated air fins, framed on four sides by a pair of parallel header tanks and a pair of parallel core reinforcements. Typically, the condenser header tanks are vertically oriented, and the tubes horizontally oriented. Some means is necessary to mount to condenser physically to the vehicle, generally in front of the engine cooling radiator. The condenser may be mounted directly to the vehicle frame, or indirectly mounted to the vehicle by mounting to the radiator. Whether it's directly or indirectly mounted to the vehicle, the condenser generally requires several brackets, securely fixed to its core structure, which can in turn receive threaded bolts or other fasteners to allow the condenser to be fixed in place. Another structural concern with condensers is the refrigerant inlet and outlet pipes to the headers, which are connected to the refrigerant lines of the vehicle after the condenser is installed. The act of connecting the lines subjects the pipes to a predetermined level or torque relative to the condenser. At least one of these pipes is typically elongated, in order to accommodate the location of the refrigerant lines, and consequently needs extra structural support to resist the installation torque without being damaged or deformed.

The alternatives for providing mounting brackets on the condenser include extruding the header tank itself with integral rails, or attaching separate brackets. Integral rails are heavy, being the full length of the extruded tank, an example of which may be seen in U.S. Pat. No. 5,671,803. Much of the weight of an extruded header tank rail can be machined away in a post extrusion manufacturing step, leaving only a discrete flange, but the extra step adds expense. Most separate mounting brackets are metal pieces that are somehow fixed to the header tank before the brazing operation and then brazed on solidly later. Numerous examples may be seen in the prior art, as in U.S. Pat. No. 5,205,349. The addition of discrete, localized metal masses to an otherwise regular metal part is undesirable in that it can introduce irregularities in the braze temperature profile, as well as interfere with the smooth stacking and running of parts on the conveyor belt. Separate mounting brackets may also be attached after the brazing operation, as shown in U.S. Pat. No. 5,535,819, where metal brackets are bolted to the condenser reinforcement after the braze operation. One or more fasteners are needed for each of four brackets, which involves considerably more labor than simply snapping a bracket to a header tank prior to the braze operation. One recent U.S. Pat. No. 6,202,737, shows a condenser attached to a radiator tank with a bracket that is described as being "nested" on top of the condenser tank before being snapped to the radiator tank. It is unclear what "nesting" means, and unclear what material is used in the bracket. The bracket shown provides no support to the condenser inlet and outlet pipes.

As noted above, another concern with condensers is support of the inlet and outlet pipes. Many patents showing separate condenser mounting brackets disclose using some portion of the mounting bracket to also provide locational support to the inlet and outlet pipes. Examples are U.S. Pat. No. 5,509,473 and the already noted U.S. Pat. No. 5,205,349. Others show separate brackets independent of the condenser mounting brackets and added just to help support the inlet and outlet pipes, such as U.S. Pat. No. 5,429,182. In addition to having all the drawbacks noted above relative to how the brackets are attached, such pipe support brackets, while they may help the hold the pipe in the right location for later refrigerant line attachment, generally do not provide significant resistance to the installation torque as defined above. Consequently, it would still be necessary to provide a back up wrench to the fitting at the end of the inlet or outlet pipe as the refrigerant line was attached, rather than a simpler and more desirable "one handed" operation. Without the back up wrench, the condenser pipe could be twisted and damaged by the torque involved. A known structure for providing "one handed" attachment of the refrigerant line to the condenser is a heavy joint block brazed directly and solidly to the condenser tank, so that a mating block on the refrigerant line can be bolted to the header tank block. An example may be seen in Japanese Published Patent Abstract 05203387. While allowing one handed attachment, the header block shown represents a large and undesirable thermal mass in the braze operation.

SUMMARY OF THE INVENTION

The subject invention provides a condenser mounting and inlet and outlet pipe support structure that resolves all the drawbacks and shortcomings noted above. The brackets are simple and light molded plastic pieces that are attached to the corners of condenser core entirely post braze, in a simple press fit operation that needs no separate fasteners. At least some of the brackets also have inlet and outlet condenser pipe supports that support the pipes solidly enough t o allow for one handed installation of the refrigerant lines thereto.

In the embodiment disclosed, the condenser has a typical core bounded on four sides by a "frame" consisting of two extruded header tanks and a pair of stamped, beam shaped core reinforcements. Both the header tanks and the core reinforcements are simple, regular parts with no separate brackets, rails or flanges to create discontinuities during the braze process. The four brackets are hollow, light weight molded plastic pieces, each of which is mounted to a respective corner of the condenser "frame." Each bracket has a cap that fits closely over the end of header tank and an integral channel on the side that snap fits over the core reinforcement, with no additional fasteners needed. Each bracket also has a bolt slot or other mounting feature to allow it to be mounted to the vehicle body or radiator. Once installed to the condenser core, the brackets gain solid twisting resistance from both sides of the condenser corner, as well as solid removal resistance from the close, snap fit. Two of the brackets are also molded with reinforced support flanges, to which the end of the condenser inlet or outlet pipe is solidly bolted or otherwise attached. This allows the refrigerant lines to be attached to the inlet and outlet pipes with no need for additional torque resistance.

BRIEF DESCRIPTION OF THE DRAWINGS

These and other features of the invention will appear from the following written description, and from the drawings, in which.

DESCRIPTION OF THE PREFERRED EMBODIMENT

Figure 1:
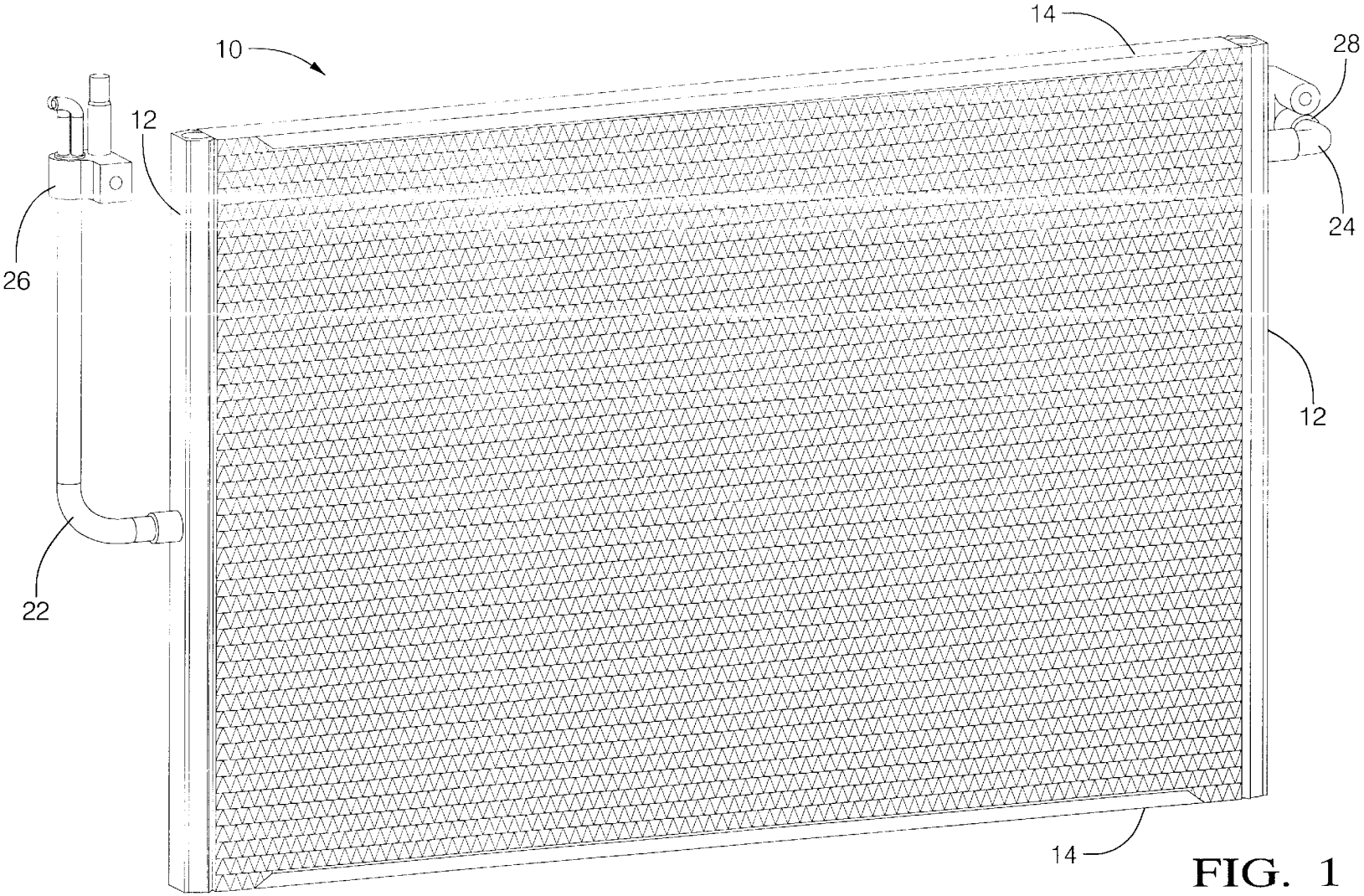
FIG. 1 is a perspective view of the condenser alone.

Referring first to FIG. 1, a typical multi tube, headered cross flow heat exchanger of the type used in automotive applications, such as a condenser indicated generally at 10, is shown. Condenser 10 comprises a basic core of conventional flow tubes and intervening air centers or air fins, which are not shown in detail, which core is bounded by a four sided, generally rectangular frame. Two sides of the frame are comprised of a pair of header tanks 12, typically brazeable aluminum alloy, and the other two sides are a pair of core reinforcements 14, stamped aluminum beams as disclosed. Each reinforcement 14 is fixed at one end to an end of a tank 12, thereby forming four right angle corners. The reinforcements 14, which are typically L or U shaped in cross section, rest over and protect the outermost pair of air centers, thereby allowing the core to be banded together prior to brazing. As disclosed, the tanks 12 are substantially continuous in cross section, with no discontinuities, except for an outlet pipe 22 on one, and an inlet pipe 24 on the other. The pipes 22 and 24 feed refrigerant into and out of the tanks 12, and their length and location is basically dictated by the vehicle architecture, and not within the control of the heat exchanger designer. As disclosed, each pipe 22 and 24 has a relatively massive aluminum block fitting 26 and 28 respectively fixed to its end, which is attached to a refrigerant line at the time of installation. In this case, a matching block on the refrigerant line end would be drawn tight to the block fitting 26 or 28 by a threaded fastener and a torque wrench. In other cases, the ends of the pipes and respective refrigerant lines could have male and female ends threaded directly together, again, with a torque applying tool of some sort. Whatever the fastening technique, a predetermined, known level of force and torque will be applied in the installation process, which has the potential, without proper resistive support, of deforming the pipes 22 and 24, unless they are somehow held steady and supported relative to the condenser 10. A counter force resistant to this potentially damaging installation torque can, as noted above, be supplied externally by the application of a second supporting tool, such as a back up wrench. It is far more desirable to be able to achieve the line to pipe installation attachment with a single tool, or "one handed." The subject invention provides that capability.

Figure 2:
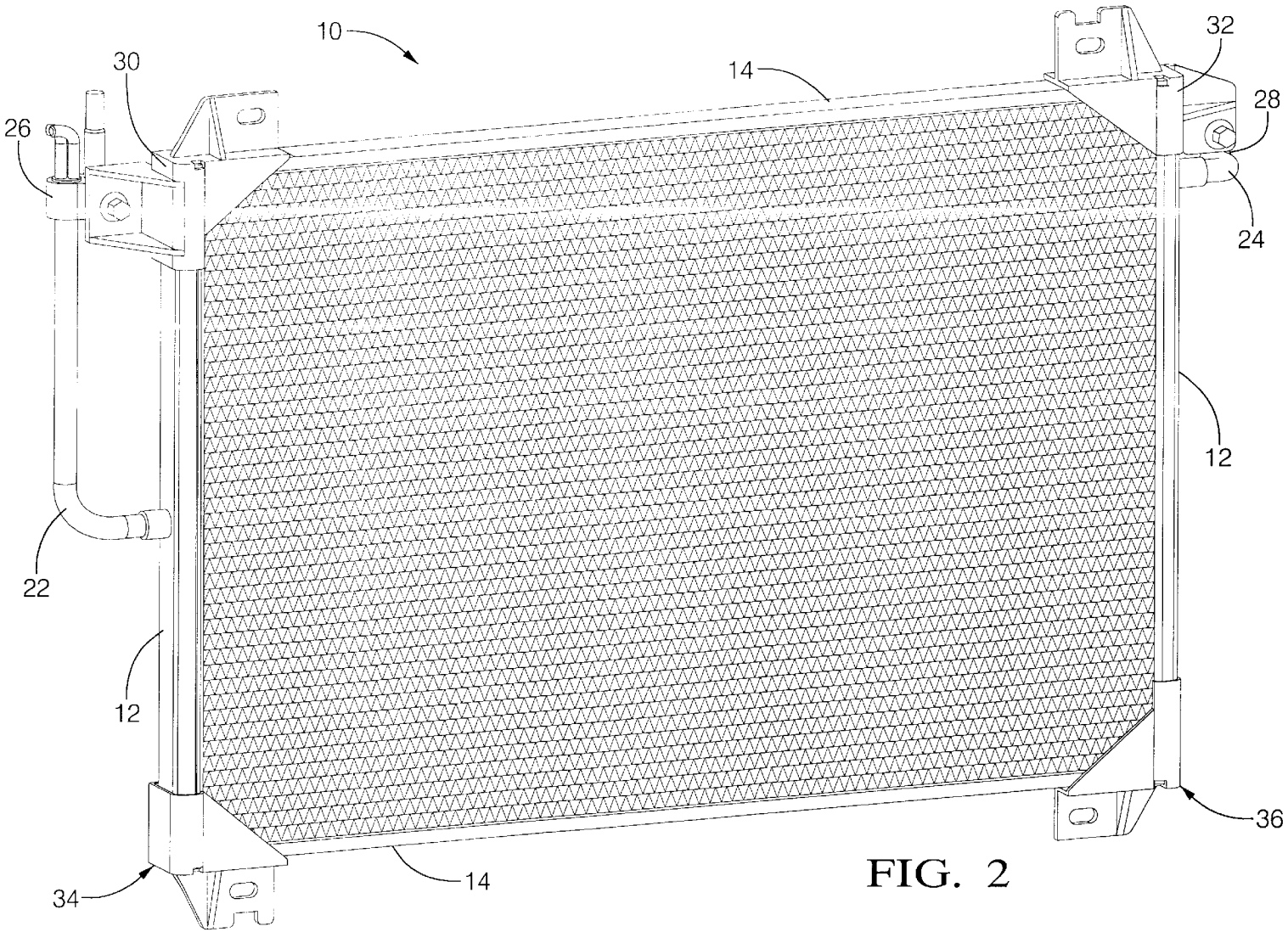
FIG. 2 is perspective view of the condenser with four brackets installed to the four corners.

Referring next to FIG. 2, condenser 10 is shown with four corner brackets attached, indicated generally at 30 through 36, starting at the upper left hand corner and working around clockwise. Each is a hollow, injection molded plastic part, attached to the corners of condenser 10 post braze and without the use of any separate fasteners. The bottom two brackets 34 and 36 provide only condenser installation, but the upper two 30 and 32 additionally provide solid support to the condenser pipes 22 and 24, or to any other appendage of the condenser 10 which may require torque resistive support. In general, the brackets 30–36 resolve all of the shortcomings of the prior art noted above, since they do not involve or disrupt the basic core braze process, do not require separate fasteners to be attached to the condenser 10, and, as is described below, provide enough support to the pipes 22 and 24 to allow one handed attachment to the refrigerant lines at installation.

Figure 3:
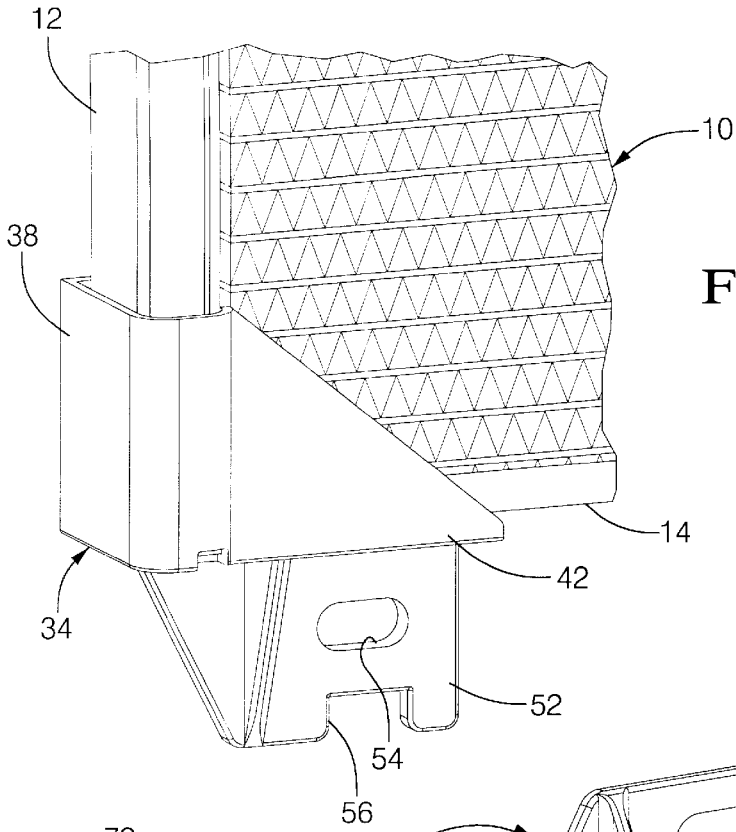
FIG. 3 is a perspective view of the bracket at the lower left hand corner of the condenser, fixed to the condenser.
Figure 4:
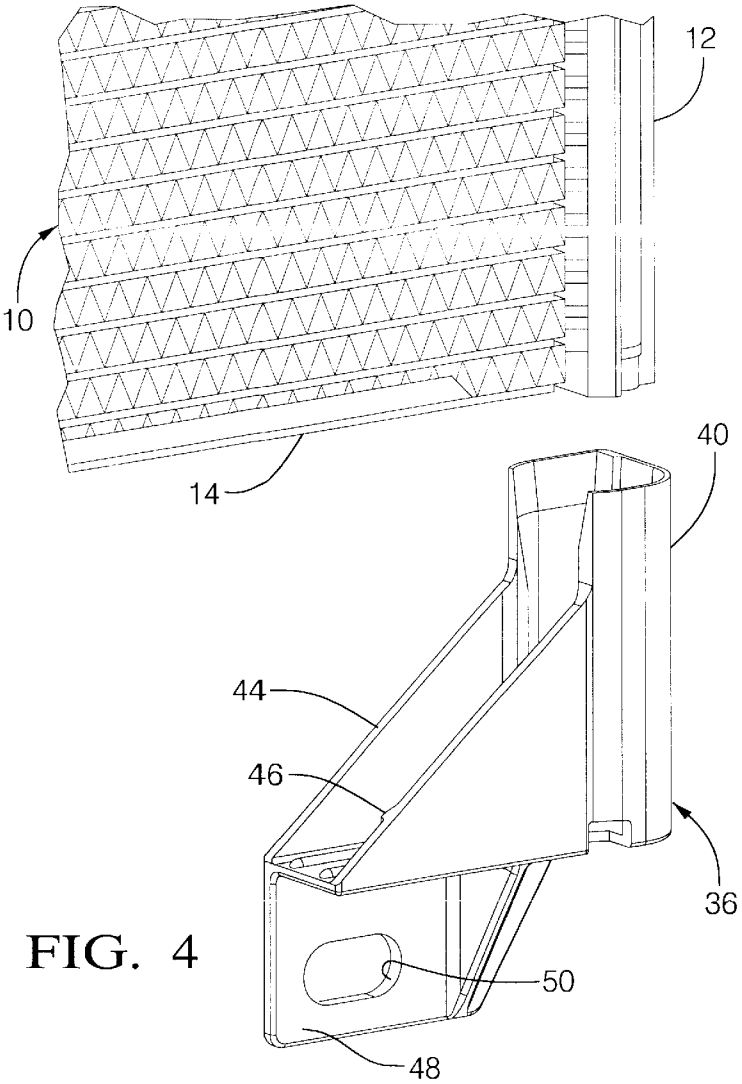
FIG. 4 is a perspective view of the bracket at the lower right hand corner of the condenser, before being fixed to the condenser.

Referring next to FIGS. 3 and 4, the lower brackets 34 and 36 provide a mounting means for condenser 10. Each has a hollow cap 38 and 40 respectively, which press fits closely down over approximately two inches of the length of a tank 12. The interior surface of the caps 38 and 40 matches the exterior surface of the tanks 12 closely, but, alone, does not provide complete resistance to pulling off of the corner. Integrally molded to the side of each cap 38 and 40 is a channel 42 and 44 respectively, which fits closely over approximately a two inch length of the core reinforcement 14, adjacent to the end of a tank 12. Molded on an inside surface of each channel 42 and 44 is a respective horizontal rib, only one of which, rib 46 on bracket 36, is visible. All brackets have an identical rib, however. Rib 46 is located such that, as channel 44 slides over the end of reinforcement 14, it snaps over the edge of reinforcement 14, providing a very strong resistance to being pulled back off. Once fully seated, bracket 36 is solidly retained to the corner of condenser 10, becoming, in effect, nearly as solid as an integral part of the condenser structure itself, and more than able to resist the level of installation torque defined above without deforming significantly relative to the corner of condenser 10. As such, the bracket 36 is prevented from twisting in either direction shown by the arrows relative to the corner of condenser 10. Extending outwardly from channel 44 is an integrally molded, reinforced mounting flange 48, with a through hole 50. Flange 48 can be used to mount the respective corner of condenser 10 solidly to any fixed vehicle structure. The stiffness of flange 48, combined with the solid twisting resistance of bracket 36, allows for a very solid installation of the condenser 10 to some other basic vehicle body structure. The other lower bracket 34 has a similar respective mounting flange 52 and through hole 54. In addition, a cut out notch 56 provides a locating feature that can be used to seat the corner is a pre determined orientation relative to whatever vehicle structure bracket 34 is attached to.

Figure 5:
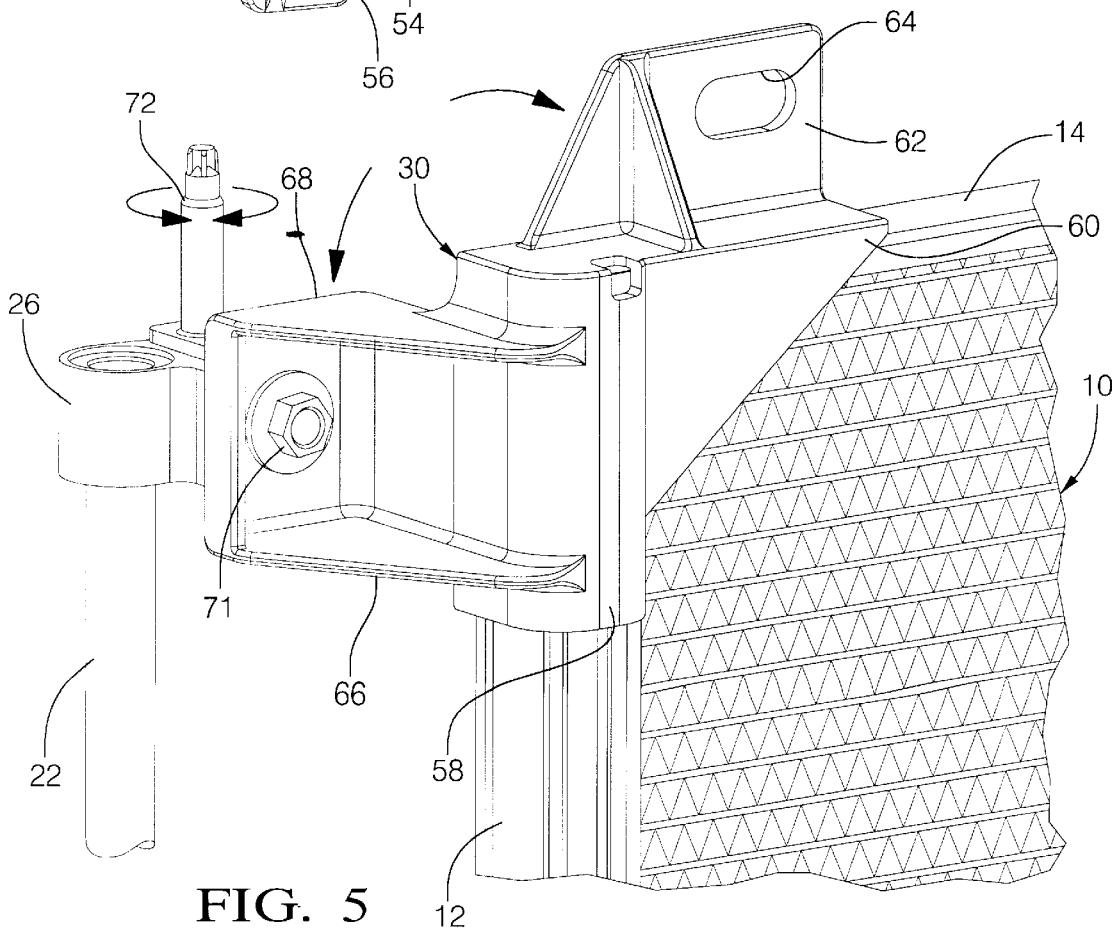
FIG. 5 is perspective view of the bracket at the upper left hand corner of the condenser, which supports the outlet pipe.
Figure 6:
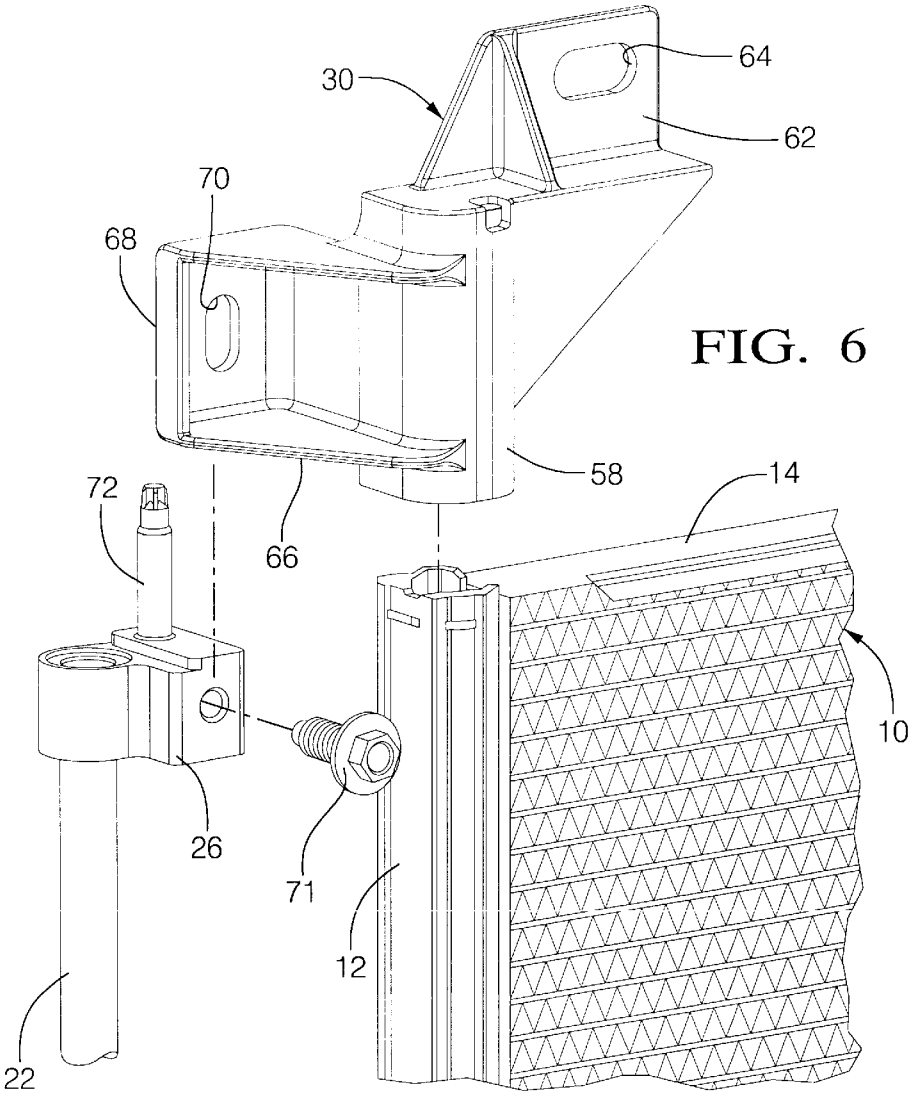
FIG. 6 is a perspective view of the bracket in FIG. 5, before being fixed to the condenser.

Referring next to FIGS. 5 and 6, the left hand corner upper bracket 30 shares some features with the diagonally opposed right hand corner lower bracket 36, but provides an additional unique feature as well. Specifically, upper bracket 30 has a cap 58, channel 60, mounting flange 62 and through hole 64 identical to corresponding parts on the diagonally opposed lower bracket 36. This allows corresponding parts to be molded by dies with the same shape. In addition, upper bracket 30 has a box shaped support flange 66 integrally molded to the side of the cap 58. The side support flange 66 terminates in a flat platform 68 with an elongated through hole 70, and its reinforced box shape makes it very stiff relative to the bracket 30, more than stiff enough to prevent it from deforming significantly relative to the bracket 30 when subjected to the level of installation torque as defined above. Since bracket 30 is solidly fixed to the corner of the condenser 10, the net result is that the support flange 66 is also very rigid and stiff relative to the condenser 10. This allows the block fitting 26 at the end of outlet pipe 22 to be solidly fastened by a screw 71 to the platform 68, which will thereby solidly support the end of outlet pipe 22 relative to condenser 10. A threaded shank 72 extends upwardly from the block fitting 26 as well, and a matching block fitting on the end of a refrigerant line would, at the time of installation, be bolted to the threaded shank 72, thereby connecting outlet 22 into the overall system. The installation tool used to make the connection to shank 72, such as a power wrench, applies a great deal of twisting torque to the block fitting 26, as shown by the arrows in FIG. 5. That torque is strongly resisted by the bracket 30, however, so that no separate torque resisting support needs to be applied to the end of outlet pipe 22. The "one handed" installation of the refrigerant line facilitated by the bracket 30 and its rigid support of pipe 22 is a great advantage at installation, just as the braze free attachment of bracket 30 to condenser 10 is a great advantage during the basic manufacturing process.

Figure 7:
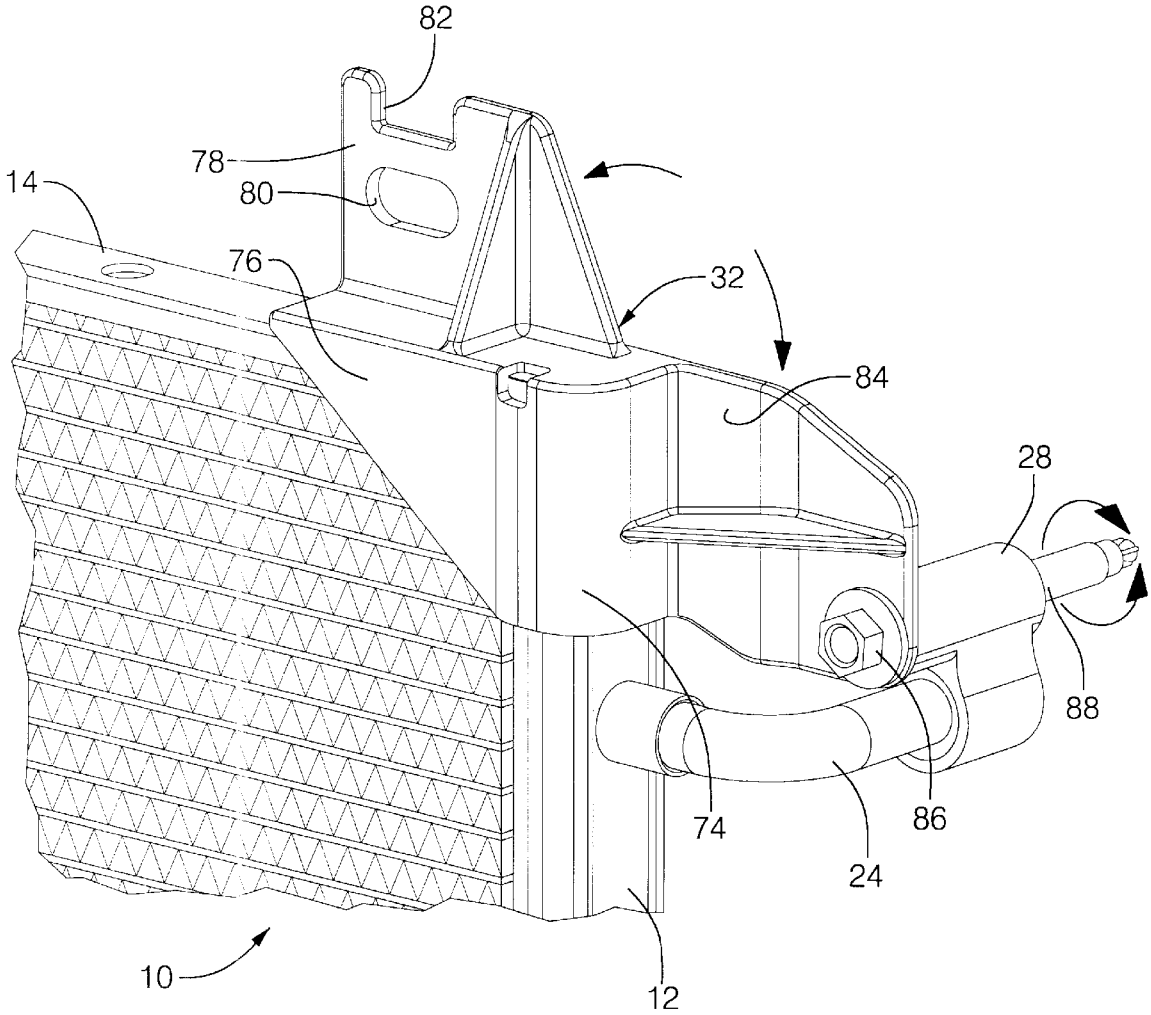
FIG. 7 is a perspective view of the bracket at the upper right hand corner of the condenser, which supports the inlet pipe.

Referring finally to FIG. 7, the upper right hand bracket 32 has the same basic function as bracket 32, and may be described more briefly. It bears a similarity to its diagonally opposed lower bracket 34 insofar as having an identical cap 74, channel 76, mounting flange 78, through hole 80, and locating notch 82, and is attached to the condenser 10 in the same, solid fashion. A support flange 84 is similar to support flange 66, but need not be as heavily reinforced (one reinforcing wall rather than two), as the inlet pipe 24 is shorter, and does not need quite as much support. Regardless, when a screw 86 is used to attach the inlet pipe block fitting 28 to the stiff side flange 84, the net result is that it is very solidly supported relative to the corner of the condenser 10. A similar threaded shank 88 on block fitting 28 allows the other refrigerant line to be joined thereto in the same, simple, one handed fashion, the same torque resistance, as indicated by the arrows.

Variations in the disclosed embodiment could be made. In other cores, the reinforcements might consist of just the outermost tubes, operational or not, or other structures that would still give the same, four sided, four cornered shape. Brackets could grip these corners tightly through mechanisms other than the snap fit disclosed, such as a very tight press fit. Since the brackets grip the corners of the condenser so closely and solidly, the support flanges could be used to support appendages of the condenser or other components associated with the heat exchanger other than just inlet and outlet pipes. For example, a receiver-drier could be mounted to one of the condenser header tanks, to which a refrigerant line would be later attached, thereby subjecting it to the same kind of installation torque that an inlet or outlet pipe sees. A bracket support flange could be used to hold such a receiver solid and steady relative to the condenser as the refrigerant line was attached to it. A rigid, reinforced support flange could also be used to transfer the basic solidity and twisting resistance of a corner mounted bracket from the heat exchanger to any other structure to be supported by that heat exchanger, as opposed to using the bracket just to mount the heat exchanger itself to the vehicle. Support could be lent even to a second heat exchanger to be supported on a first. For example, with radiators having molded plastic tanks, it is relatively easy to mold various complex structures directly to the plastic header tanks, which can be used for support or other purposes later. There is a trend toward all metal radiator designs, which have braze sealed, all metal header tanks and core reinforcements, creating simple, four sided metal frame structures similar to brazed condensers. All metal radiators also have the same issues as condensers in terms of the difficulties in attaching metal mounting brackets to the metal header tanks. With the subject invention, similar corner mounted brackets with closely fitting caps on the end of the header tank and tightly gripping side channels could be used to support other radiator components, or even a condenser. Therefore, it will be understood that it is not intended to limit the invention to just the embodiment disclosed.

What is claimed is:

1. For use on a brazed heat exchanger having a basic four sided, four cornered frame construction comprised of a substantially parallel pair of metal header tanks and a substantially parallel pair of metal reinforcements joined to the ends of the header tanks, said heat exchanger also having an additional component associated therewith which is subjected to a predetermined installation torque relative said heat exchanger, a support bracket for resisting said installation torque, comprising in combination, at least one molded plastic bracket installed by a press fit to one corner of said heat exchanger, said bracket having a cap closely fitted to an end of a header tank and an integral channel tightly gripping the core reinforcement adjacent thereto, thereby creating a solid twisting resistance relative to said heat exchanger, said molded plastic bracket further comprising a support flange integrally molded thereto that is sufficiently stiff to resist said predetermined torque relative to said bracket, said support flange being solidly attached to said additional component, whereby the net effect of the installation of said bracket to said heat exchanger and the attachment of said additional component to said bracket support flange is to resist the installation torque to which said additional component is subjected.

2. In a brazed heat exchanger having a basic four sided, four cornered frame construction comprised of a substantially parallel pair of metal header tanks and a substantially parallel pair of metal reinforcements joined to the ends of the header tanks, and at least one molded plastic bracket installed by a press fit to one corner of said heat exchanger, said bracket having a cap closely fitted to an end of a header tank and an integral channel tightly gripping the core reinforcement adjacent thereto, thereby creating a solid twisting resistance relative to said heat exchanger, said heat exchanger also having an additional component associated therewith which is subjected to a predetermined installation torque relative said heat exchanger, the improvement comprising, a support flange integrally molded to said bracket that is sufficiently stiff to resist said predetermined torque relative to said bracket, said support flange being solidly attached to said additional component, whereby the net effect of the installation of said bracket to said heat exchanger and the attachment of said additional component to said bracket support flange is to resist the installation torque to which said additional component is subjected.

3. A support bracket according to claim 1, wherein said heat exchanger is an automotive condenser.

4. A support bracket according to claim 3, wherein said additional component is an inlet or outlet pipe.

5. A support bracket according to claim 4, wherein said support flange has a reinforced box shape.

6. A support bracket according to claim 5, wherein said inlet or outlet pipe has a block fitting at the end that is fixed to said support flange.

* * * * *